US005873290A

United States Patent [19]

Chaconas

[11] Patent Number: 5,873,290

[45] Date of Patent: Feb. 23, 1999

[54] HEX HEAD WRENCH

[75] Inventor: Peter Constantine Chaconas, Glyndon, Md.

[73] Assignee: Hand Tool Design Corporation, Wilmington, Del.

[21] Appl. No.: 870,463

[22] Filed: Jun. 6, 1997

[51] Int. Cl.[6] ..... B25B 13/48

[52] U.S. Cl. ..... 81/436; 81/186; 81/461

[58] Field of Search ..... 81/436, 460, 461, 81/186

[56] References Cited

U.S. PATENT DOCUMENTS

| | | | |
|---|---|---|---|
| 2,083,092 | 6/1937 | Richer | 85/45 |
| 3,658,105 | 4/1972 | Burt et al. | 145/50 A |
| 4,269,246 | 5/1981 | Larson et al. | 81/460 |
| 4,338,835 | 7/1982 | Simons | 81/436 |
| 4,361,412 | 11/1982 | Stolarczyk | 81/119 |
| 4,625,598 | 12/1986 | Wolfram | 81/436 |
| 5,259,279 | 11/1993 | Strauch | 81/436 |
| 5,279,190 | 1/1994 | Goss et al. | 81/460 |
| 5,284,075 | 2/1994 | Strauch et al. | 81/436 |

FOREIGN PATENT DOCUMENTS

| | | | |
|---|---|---|---|
| 3326584 | 3/1984 | Germany | 81/436 |

*Primary Examiner*—David A. Scherbel
*Assistant Examiner*—Benjamin M. Halpern
*Attorney, Agent, or Firm*—Leonard Bloom

[57] ABSTRACT

A hexagonal head wrench having a body, six sides and six corners. A protuberance is formed on each corner. Each protuberance has two oppositely oriented flank members angled at a predetermined angle outwardly and away from each corner. Engagement of the wrench with a fastener occurs on a portion of each respective flank member distal from the corner. Continued application of torque progressively radially engages each flank member with the fastener.

8 Claims, 5 Drawing Sheets

PRIOR
ART

HEX HEAD WRENCH

BACKGROUND OF THE INVENTION

The present invention relates to a hex head wrench and in particular to a hex head wrench which has angled flank surfaces which progressively engage a fastener.

The hex head wrench is widely used with fasteners having a hexagonal opening in the head of the fastener. The commonly used wrench has six driving surfaces which engage the sides of the opening in the fastener and which imparts high stress on the corner portions of the wrench when torque is applied. In order to reduce this problem, U.S. Pat. No. 5,284,075 to Strauch et al disclose a screwing tool having flank sections which are convex in a circumferential direction and in which the central region of each flank has a non-convex intermediate section. Another approach to the problem is disclosed in U.S. Pat. No. 2,083,092 to Richer. A screw and a cooperating wrench have a series of alternating concave and convex arcs tangentially joining one another so as to form a plurality of equispaced inflections. Goss et al in U.S. Pat. No. 5,279,190 disclose a torque transmitting arrangement for a fastener drive system. The externally configured and the internally configured components are both provided with a series of mating, elliptically curved flutes and lobes.

The applicant is also aware of the following U.S. Patents which disclose tools for driving a fastener.

U.S. Pat. No. 3,658,105 Burt et al

U.S. Pat. No. 4,269,246 Larson et al

U.S. Pat. No. 4,338,835 Simons

U.S. Pat. No. 4,625,598 Wolfram

U.S. Pat. No. 5,259,279 Strauch

However, none of these patents disclose a wrench, and especially a hexagonal wrench, with a driving portion which has flank surfaces and radial surfaces to reduce stress and to transmit torque.

BRIEF SUMMARY OF THE INVENTION

It is an object of the present invention to provide a hex head wrench which transmits torque to a hex opening fastener with greatly reduced stress on the wrench and without damaging the fastener.

It is another object of the present invention to reduce stress on the fastener and on the wrench at the extremes of tolerance dimensions of the fastener.

In accordance with the teachings of the present invention, there is disclosed a hexagonal head wrench for driving a fastener having a hexagonal opening. The wrench has a body having six sides, the intersection of the sides defining six corners. A protrusion is formed about each corner. Each protrusion has two flank surfaces oriented in opposite directions from the respective corner toward the next adjacent corner. Each flank surface at each corner is angled at a predetermined angle outwardly and away from each respective corner. In this manner, engagement of the fastener by the wrench initially occurs on a portion of the respective flank surface distal from the corner and continued application of torque progressively radially engages the flank surface with the fastener.

These and other objects of the present invention will become apparent from a reading of the following specification taken in conjunction with the enclosed drawings.

DESCRIPTION

Figure 2:
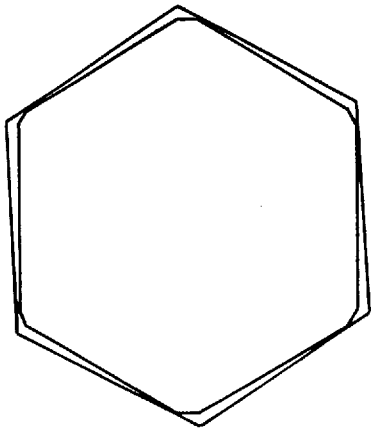
FIG. 2 PRIOR ART
FIG. 2 is a cross-sectional view taken across the lines 2—2 of FIG. 1.
Figure 1:
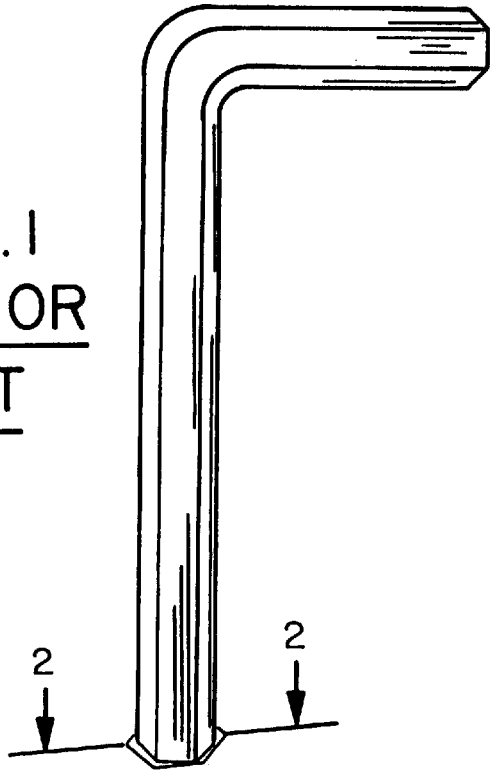
FIG. 1 is a perspective view showing a hex wrench of the prior art contacting the walls of the opening in a fastener when the wrench has been moved through the maximum tolerance of the fastener.

The hex head wrench which is commonly used is shown in FIGS. 1 and 2. The side walls of the wrench are substantially flat surfaces which are at angles of 120° with respect to one another. As the wrench is rotated within the opening in the fastener, the initial points of contact on the wrench are very close to the corner where the side walls intersect. Continued application of torque causes engagement of the flat driving surface of the wrench progressively from the initial point of contact toward the next adjoining corner in the direction of rotation. This produces very high stress on the driving surfaces. When the opening in the fastener is at the maximum tolerance value, the wrench must be rotated through a greater arc to effectively transmit the torque to the fastener as compared to a fastener having a minimum tolerance value.

Figure 4:
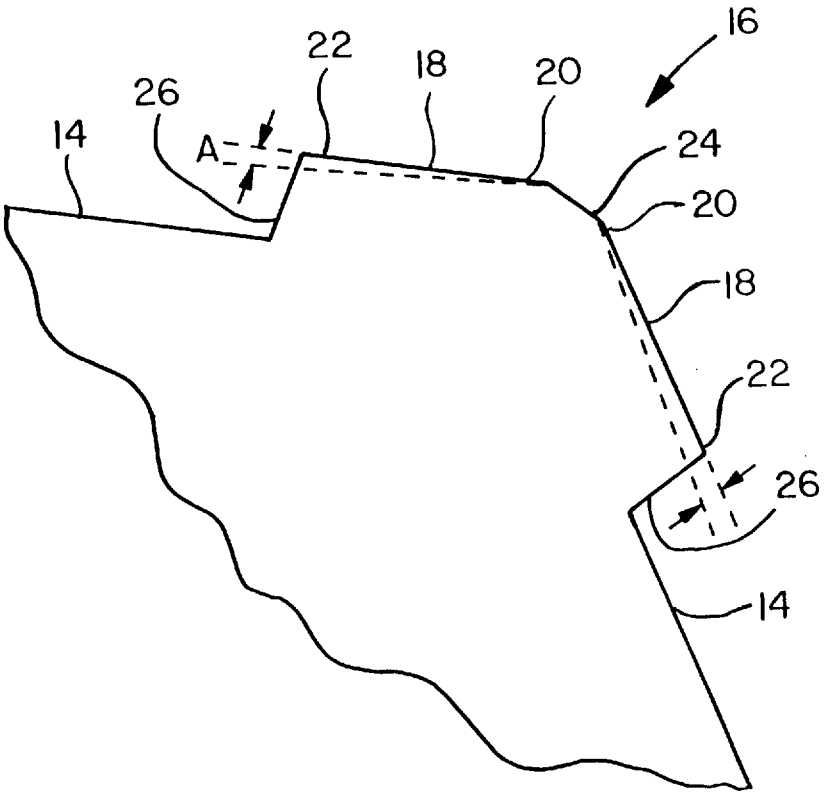
FIG. 4 is an enlarged partial top plan view showing the angle of the flank member.
Figure 3:
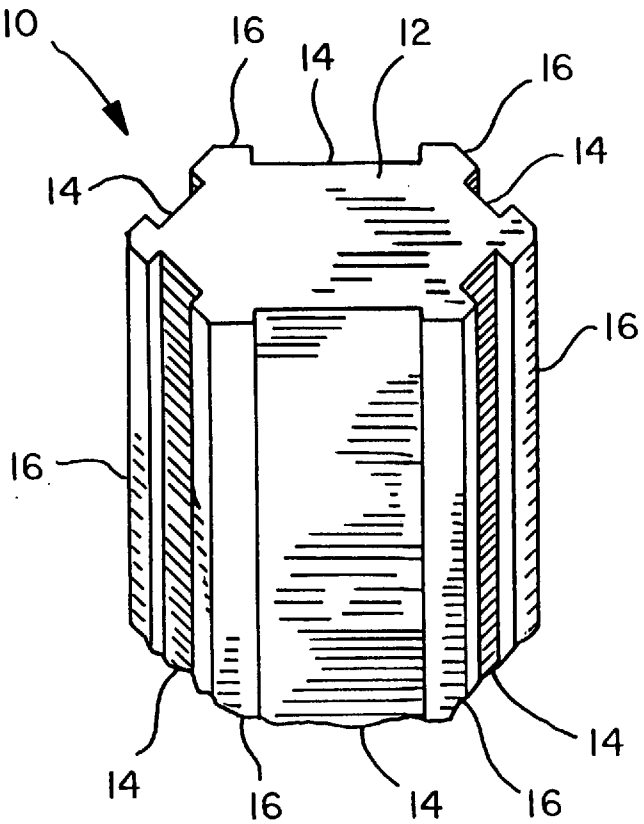
FIG. 3 is a perspective view of the end of the wrench of the present invention.

Referring to FIGS. 3–4, the hex head wrench 10 of the present invention has a body 12 with six sides 14. The intersection of the sides 14 define six corners. A protuberance 16 is formed about each corner. Each protuberance 16 has two flank surfaces 18; the flank surfaces 18 are oriented in opposite directions from the respective corner toward the next adjacent corner. Each flank surface 18 has a first end 20 and an opposite second end 22 to define the length of the flank surface 18. The lengths of all the flank surfaces 18 are equal to one another. Preferably, the respective first ends 20 of the flank members 18 at each corner are joined by a respective connecting member 24. Each flank surface 18 is angled at a predetermined angle A outwardly and away from each respective corner. The predetermined angle A may be 0° to 5°. Preferably, the predetermined angle is approximately 3°. The second end 22 of each flank surface 18 is connected to a respective radial surface 26. Each radial surface 26 extends between the second end 22 of each flank surface 18 and the side 14 of the body 12 of the wrench 10. Each radial surface 26 may be parallel to a respective radius R drawn from the axial center 28 of the wrench 10 to the second end 22 of each respective flank surface 18. Alternately, each radial surface 26 may be at a rake angle with respect to the respective radius. Preferably, the rake angle is positive, that is the angle between side 14 and radial surface 26 is decreased.

The wrench 10 of the present invention may also be viewed as a body 12 with six faces 16 having a respective longitudinal channel 14 formed about the midpoint of each face 16. The channel 14 preferably extends the length of the wrench. The intersection of the faces 16 define six corners. Each face 16 which extends from adjacent corners is interrupted by the channel 14 to form two flank surfaces 18. The flank surfaces 18 are each angled outwardly and away from the adjacent corners at a predetermined angle A. The predetermined angle A may be 0° to 5° and preferably is approximately 3°.

Figure 6:
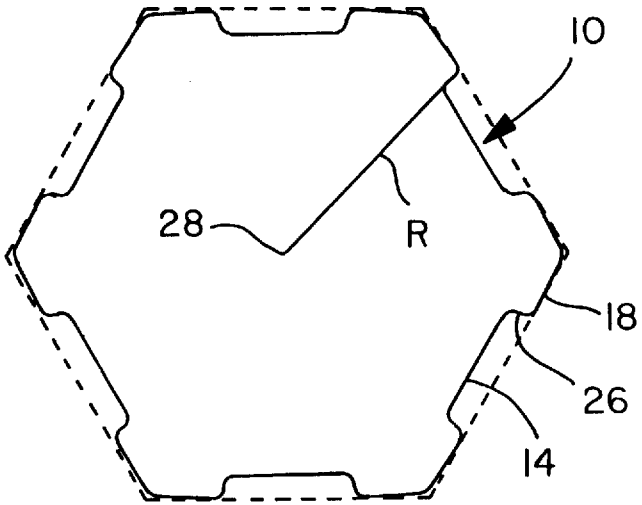
FIG. 6 is a top plan view of the wrench of the present invention disposed in a fastener head which has minimum tolerance.
Figure 5:
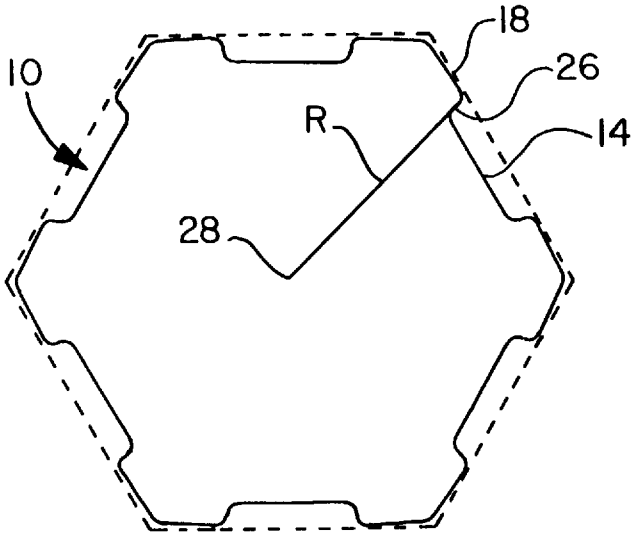
FIG. 5 is a top plan view of the wrench of the present invention disposed in a fastener head which has maximum tolerance.
Figure 8:
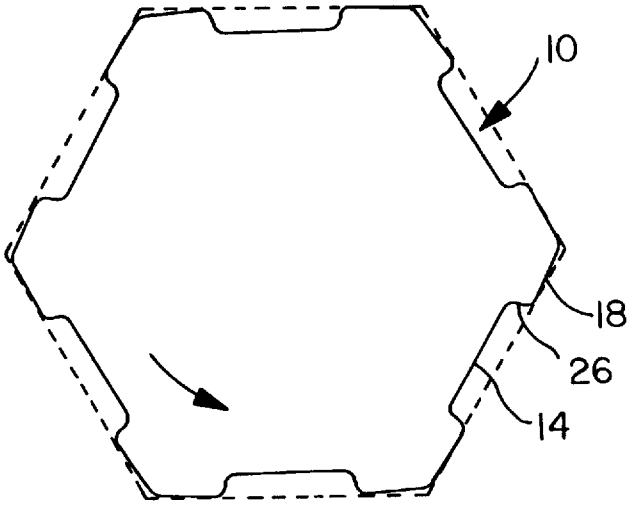
FIG. 8 is the wrench of FIG. 6 rotated through 1° to use up to tolerance clearance.
Figure 7:
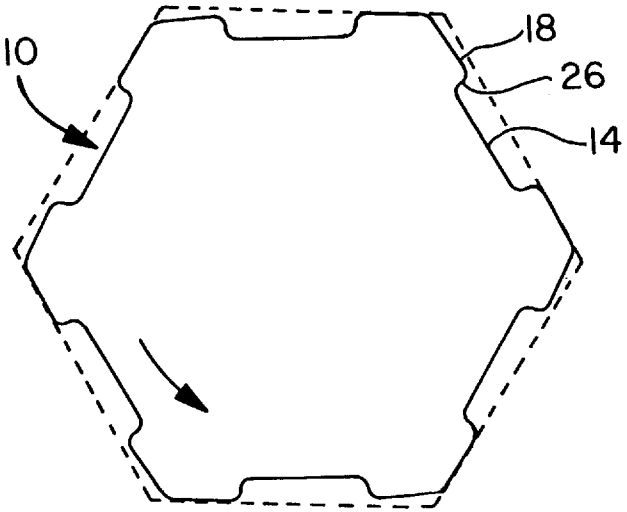
FIG. 7 is the wrench of FIG. 5 rotated through 3° to use up to tolerance clearance.
Figure 10:
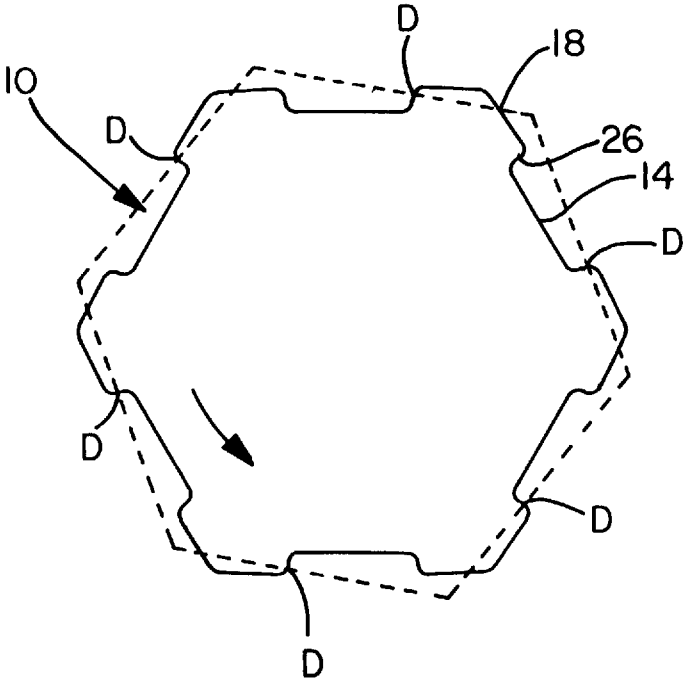
FIG. 10 is the wrench of FIG. 6 rotated to overload conditions.
Figure 9:
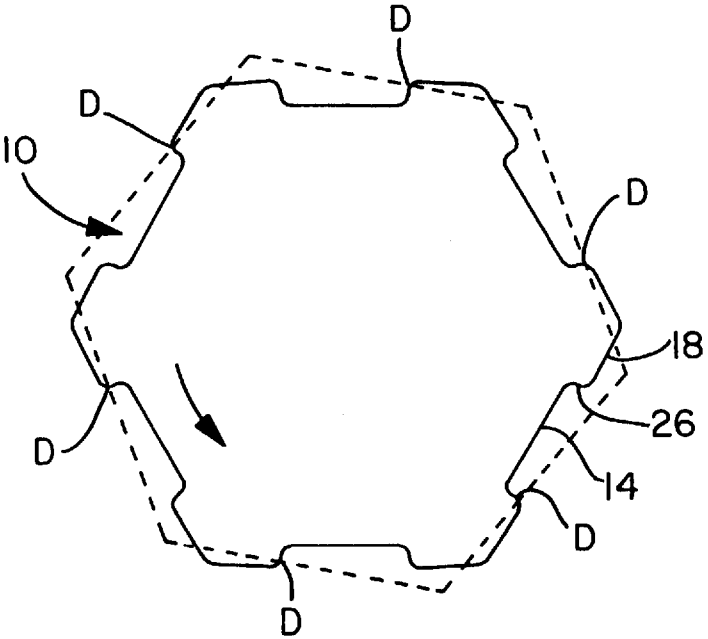
FIG. 9 is the wrench of FIG. 5 rotated to overload conditions.

FIGS. 5, 7 and 9 show the wrench of the present invention used with a fastener in which the hexagonal opening in the fastener (shown in broken lines) is at a maximum tolerance value. In FIGS. 6, 8 and 10, the opening in the fastener (shown in broken lines) is at a minimum tolerance value. In FIGS. 5 and 6, the wrench 10 is disposed in the fastener opening without rotation of the wrench. FIGS. 7 and 8 show the wrench 10 rotated in a counterclockwise direction although rotation in a clockwise direction produces the same effects as will be described. With a fastener opening of maximum tolerance, the flank surfaces 18 of the wrench are substantially parallel to the side walls of the opening. With the fastener opening of minimum tolerance, the flank surfaces 18 of the wrench are nearly parallel to the side walls of the opening. In either fastener opening, initial contact with the side walls of the opening is made by the flank surfaces 18 at approximately the intersection of the second end 22 of the flank surface 18 and the adjoining radial surface 26. In this manner, initial torque is transmitted from the wrench 10 to the fastener. Continued rotation of the wrench 10 progressively radially engages the flank surface 18 such that plastic deformation occurs on the softer surfaces of the opening of the fastener. As shown in FIGS. 9 and 10 the deformation of the fastener sides is at second end 22 of the flank surface and shown by indicator D at overload conditions. Thus, the torque generating forces are applied at approximately right angles to the radial surfaces 26 on the wrench and the torque is more efficiently transmitted to the fastener as compared to the commonly used wrench as shown in FIGS. 1 and 2.

The wrench 10 of the present invention avoids damage to the corners of the wrench.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench for driving a fastener having a hexagonal opening, the wrench comprising a body having six sides, wherein each pair of adjacent sides are connected by a respective protuberance, each protuberance having a midpoint, two flank surfaces extending radially from the midpoint of the protuberance, the flank surfaces being oriented in opposite directions from each other, each flank surface being disposed at a selected angle outwardly with respect to the respective side of the body, such that the respective flank surfaces of the wrench engage the opening in the fastener, wherein each flank surface has a first end proximal to the midpoint of the protuberance and a second end distal from the midpoint of the protuberance, such that engagement of the respective flank surface with the opening in the fastener initially occurs at the second end of the respective flank surface and continued application of torque progressively engages the respective flank surface with the fastener.

2. The wrench of claim 1, wherein the selected angle is approximately 3°.

3. The wrench of claim 1, wherein the second end of each flank surface is connected to the respective side of the body by a respective radial surface.

4. The wrench of claim 3, wherein each radial surface is parallel to a respective radius drawn from an axial center of the wrench to the second end of each respective flank surface such that torque forces are transmitted at approximately right angles from each radial surface to the fastener.

5. The wrench of claim 3, wherein each radial surface is at a rake angle in relation to a respective radius drawn from an axial center of the wrench to the second end of each respective flank surface.

6. A hexagonal head wrench for driving a fastener having a hexagonal opening, the wrench comprising a body having six faces, the intersection of the faces defining six corners, a channel being formed about a midpoint of each respective face and forming two separated flank surfaces on each face, each flank surface being angled outwardly from the respective corners toward the respective channel, such that rotation of the wrench in a first direction causes engagement of the fastener by the wrench initially occurring at a point on one of the flank surfaces on each respective face and continued application of torque progressively engages the one of the flank surface of each respective face and produces plastic deformation of the fastener, and such that rotation of the wrench in a second opposite direction causes engagement of the wrench initially occurring at a point on the other of the flank surfaces on each respective face and continued application of torque progressively engages the other of the flank surfaces of each respective face and produces plastic deformation of the fastener.

7. The wrench of claim 6, wherein the angle of the flank surface is less than 5°.

8. The wrench of claim 7, wherein the angle of the flank surface is approximately 3°.

* * * * *